US007484727B2

(12) United States Patent
Yang

(10) Patent No.: US 7,484,727 B2
(45) Date of Patent: Feb. 3, 2009

(54) MEDIA CASSETTE WITH REMOVABLE SPACER USED IN A PRINTING APPARATUS

(75) Inventor: Yong-Sok Yang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 288 days.

(21) Appl. No.: 11/110,676

(22) Filed: Apr. 21, 2005

(65) Prior Publication Data

US 2005/0242492 A1 Nov. 3, 2005

(30) Foreign Application Priority Data

Apr. 28, 2004 (KR) ..... 10-2004-0029668
Sep. 20, 2004 (KR) ..... 10-2004-0075060

(51) Int. Cl.
*B65H 1/00* (2006.01)

(52) U.S. Cl. ..... 271/171; 271/241

(58) Field of Classification Search ..... 271/145, 271/171, 220, 241; 399/393, 395
See application file for complete search history.

(56) References Cited

U.S. PATENT DOCUMENTS 5,163,670 A * 11/1992 Sellers et al. ..... 271/157
5,188,351 A 2/1993 Gysling
5,263,702 A 11/1993 Labua
5,470,160 A 11/1995 Nowlin
5,599,120 A 2/1997 Conrad et al.
5,626,334 A * 5/1997 Kondo et al. ..... 271/121
5,647,585 A 7/1997 Cheong
5,666,595 A * 9/1997 Sameshima et al. ..... 399/110
5,775,687 A * 7/1998 Nakatani et al. ..... 271/145
6,158,907 A 12/2000 Silverbrook et al.
6,179,499 B1 * 1/2001 Beretta et al. ..... 400/605
6,270,271 B1 8/2001 Fujiwara
6,419,410 B1 * 7/2002 Osmus et al. ..... 400/624
6,612,564 B1 * 9/2003 Todd ..... 271/145
6,666,601 B1 12/2003 Bingham et al.
6,926,269 B2 * 8/2005 Ishikuro ..... 271/171
6,985,265 B2 * 1/2006 Ito ..... 358/400
7,111,842 B2 * 9/2006 Taku ..... 271/241
2003/0234486 A1 * 12/2003 Taku ..... 271/264
2004/0070138 A1 * 4/2004 Ishikuro ..... 271/171
2004/0253032 A1 * 12/2004 Kojima ..... 400/101

FOREIGN PATENT DOCUMENTS

EP 0 475 229 3/1992
JP 55-172241 12/1980
JP 62-065835 3/1987
JP 62-205932 9/1987
JP 01-233463 9/1989
JP 02-147357 6/1990

(Continued)

*Primary Examiner*—Patrick H Mackey
*Assistant Examiner*—Gerald W McClain
(74) *Attorney, Agent, or Firm*—Roylance, Abrams, Berdo & Goodman, L.L.P.

(57) ABSTRACT

Provided is a removably detachable portable media cassette for a printing apparatus. The media cassette of a printing apparatus includes a loading case to load a first medium. A spacer is detachably installed on the loading case to guide two or more media having different sizes from that of the first medium.

8 Claims, 9 Drawing Sheets

FOREIGN PATENT DOCUMENTS

| | | | |
|---|---|---|---|
| JP | 3-42423 | | 2/1991 |
| JP | 03-297737 | | 12/1991 |
| JP | 03297737 A | * | 12/1991 |
| JP | 04-173377 | | 6/1992 |
| JP | 05-139546 | | 6/1993 |
| JP | 05-185690 | | 7/1993 |
| JP | 05-278870 | | 10/1993 |
| JP | 09-086788 | | 3/1997 |
| JP | 09-254451 | | 9/1997 |
| JP | 10-087094 | | 4/1998 |
| JP | 11-59925 | | 3/1999 |
| JP | 11-079428 | | 3/1999 |
| JP | 11-138911 | | 5/1999 |
| JP | 11-334892 | | 12/1999 |
| JP | 2000-247456 | | 9/2000 |
| JP | 2003-176039 | | 6/2003 |
| JP | 2003-320730 | | 11/2003 |
| KR | 1995-0004589 | | 7/1994 |
| KR | 20-0151922 | | 8/1998 |
| KR | 1998-042901 | | 9/1998 |
| KR | 20-0198334 | | 6/2000 |
| KR | 10 2002 0004269 | | 1/2002 |
| KR | 10 2002 0050496 | | 6/2002 |
| KR | 10 2003 0086120 | | 11/2003 |
| KR | 10 2004 0051379 | | 6/2004 |

* cited by examiner

MEDIA CASSETTE WITH REMOVABLE SPACER USED IN A PRINTING APPARATUS

BACKGROUND OF THE INVENTION

This application claims the benefit under 35 U.S.C. 119(a) of Korean Patent Application Nos. 2004-0029668, filed on Apr. 28, 2004, and 2004-0075060, filed on Sep. 20, 2004, the entire disclosures of which are hereby incorporated by reference.

1. Field of the Invention

The present invention relates to a media cassette of a printing apparatus. More particularly, the present invention relates to a removably detachable portable media cassette that may be separated from the printing apparatus and includes a loading case and a spacer.

2. Description of the Related Art

A printing apparatus, particularly, a portable printing apparatus such as a small photo-printer includes a portable media cassette. The portable media cassette receives media. For purposes of convenience, the media cassette may be separated from the printing apparatus.

The printing apparatus uses various kinds of media that have different sizes from each other. Typically, media cassettes receive only one kind of medium. Therefore, in order to use various kinds of media, various media cassettes should be used. However, using various media cassettes is burdensome on consumers and increases production costs for manufacturers. Additionally, a user should select media cassettes corresponding to a size of medium on which the image will be printed and install the media cassette in the printing apparatus. Furthermore, in a case of using a portable printing apparatus, a plurality of media cassettes should accompany the printing apparatus.

Accordingly, there is a need for a media cassette of a printing apparatus that simplifies loading operations of various kinds of media and reduces costs associated with production.

SUMMARY OF THE INVENTION

An aspect of the present invention is to solve at least the above problems and/or disadvantages and to provide at least the advantages described below. Accordingly, an aspect of the present invention is to provide a media cassette for a printing apparatus that simplifies use, is convenient, and reduces costs.

According to an aspect of the present invention, there is provided a detachable media cassette for a printing apparatus. The media cassette is portable. The media cassette includes a loading case having a first guide, and a spacer that is detachably installed on the loading case to guide two or more media having different sizes from that of the first medium.

The loading case may include a first guide to transversely guide both edge portions of the first medium, and a first stopper that longitudinally guides an end portion of the first medium.

It is preferable that the first guide may include a first elastic arm to elastically and transversely guide an edge portion of the first medium in the width direction.

The spacer may also include a second guide to transversely guide both edge portions of a second medium. A third guide is formed and steps inwardly from the second guide. Therefore, the third guide guides both edge portions of a third medium which has a narrower width and a longer length than that of the second medium. A second stopper is formed on a stepped boundary between the second and third guides to longitudinally guide an end portion of the second medium. A third stopper longitudinally guides an end portion of the third medium. The second and third guides may respectively include a second arm and a third arm to elastically and transversely guide edge portions in the directions of the second and third media. In addition, the spacer may further include a rotary stopper that is installed on at least one of the second and third guides to rotate to a first position to longitudinally guide an end portion of a fourth guide that has the same width and a shorter length as that of the medium guided by the corresponding medium. The rotary stopper is also rotatable to a second position to load the medium that is guided by the corresponding guide.

The spacer may include a fifth guide to transversely guide both edge portions of a fifth medium. A fifth stopper longitudinally guides an end portion of the fifth medium. A rotary stopper installed on the fifth guide and is rotatable to a first position to guide an end portion of a sixth medium that has the same width and shorter length as that of the fifth medium. The rotary stopper is rotatable to a second position to loading the fifth medium. The fifth guide may include a fifth elastic arm that elastically and transversely guides at least one edge portion in the transverse direction of the fifth and sixth media.

The loading case may include a plurality of reference holes, and the spacer may include a plurality of bosses that are inserted into the reference holes. The media cassette may further include an upper cover substantially covering an upper portion of the loading case. The upper cover does not cover the outlet so that the pickup device in the printing apparatus may access the medium for pickup. The upper cover may be rotatably coupled to the loading case in order to open the upper portion of the loading case.

The media cassette may further include a knock-up plate lifting the medium mounted on the loading case toward the pickup device disposed in the media.

The spacer may also include a plurality of guides successively stepped to transversely guide both edge portions of a plurality of media having different widths. A plurality of stoppers formed on stepped boundaries between the plural guides longitudinally guide end portions of the plural media.

The spacer may include a fifth guide to transversely guide both end portions of the fifth medium. A fifth stopper longitudinally guides an end portion of the fifth medium. At least one rotary stopper is installed on the fifth guide and is rotatable to a first position to guiding end portions of a plurality of media which have the same widths and a shorter length than that of the fifth medium. The rotary stopper is also rotatable to a second position to load the fifth medium.

The spacer may include one or more stepped structures to transversely and longitudinally guide edge and end portions of two or more kinds of media.

The spacer may include one or more rotary stoppers that are rotatable to a first position to longitudinally guide an end portion of the two or more media and a second position to guide the other media.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for conciseness.

Figure 1:
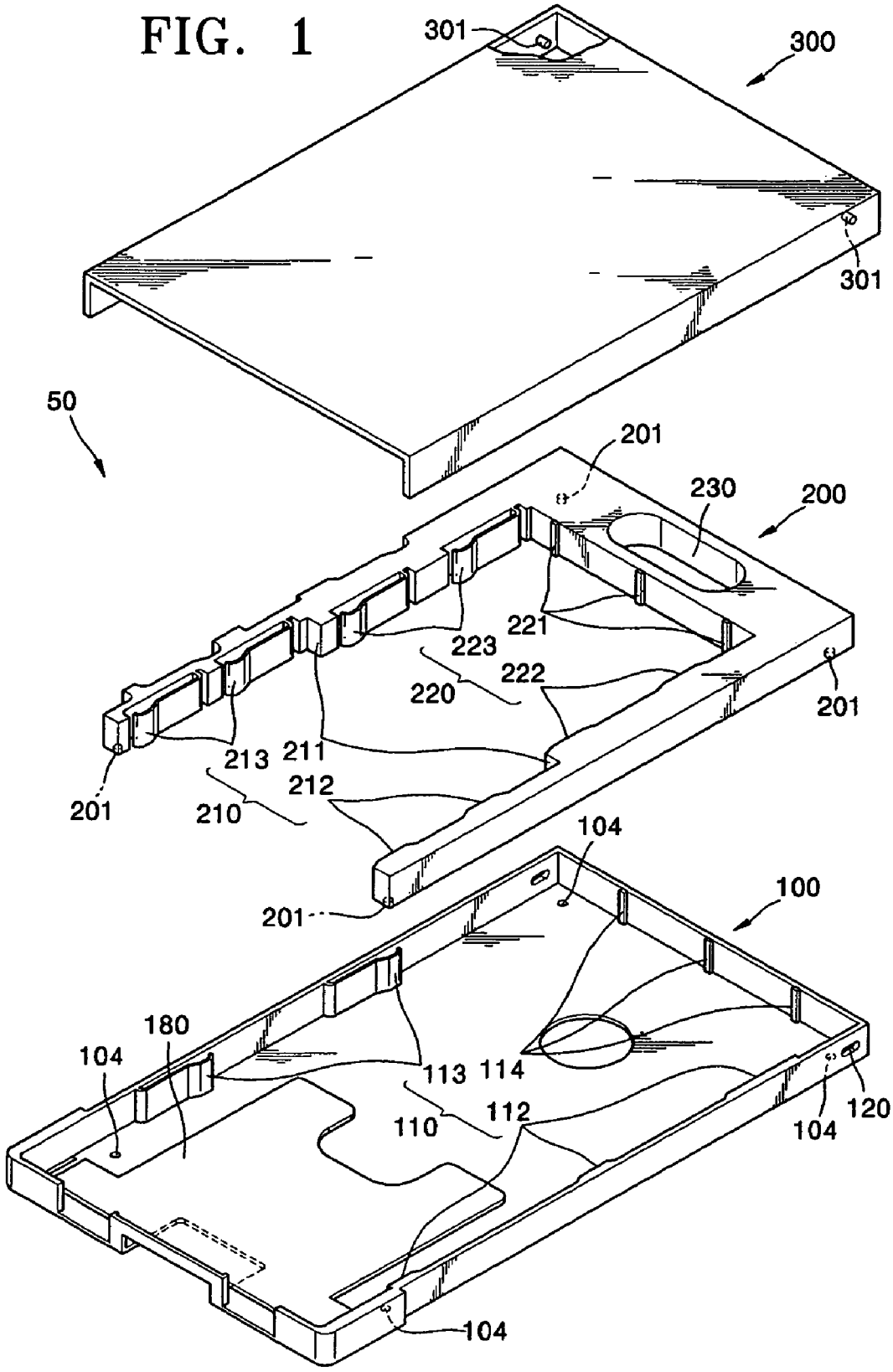
FIG. 1 is an exploded perspective view showing a media cassette in accordance with an embodiment of the present invention.
Figure 2:
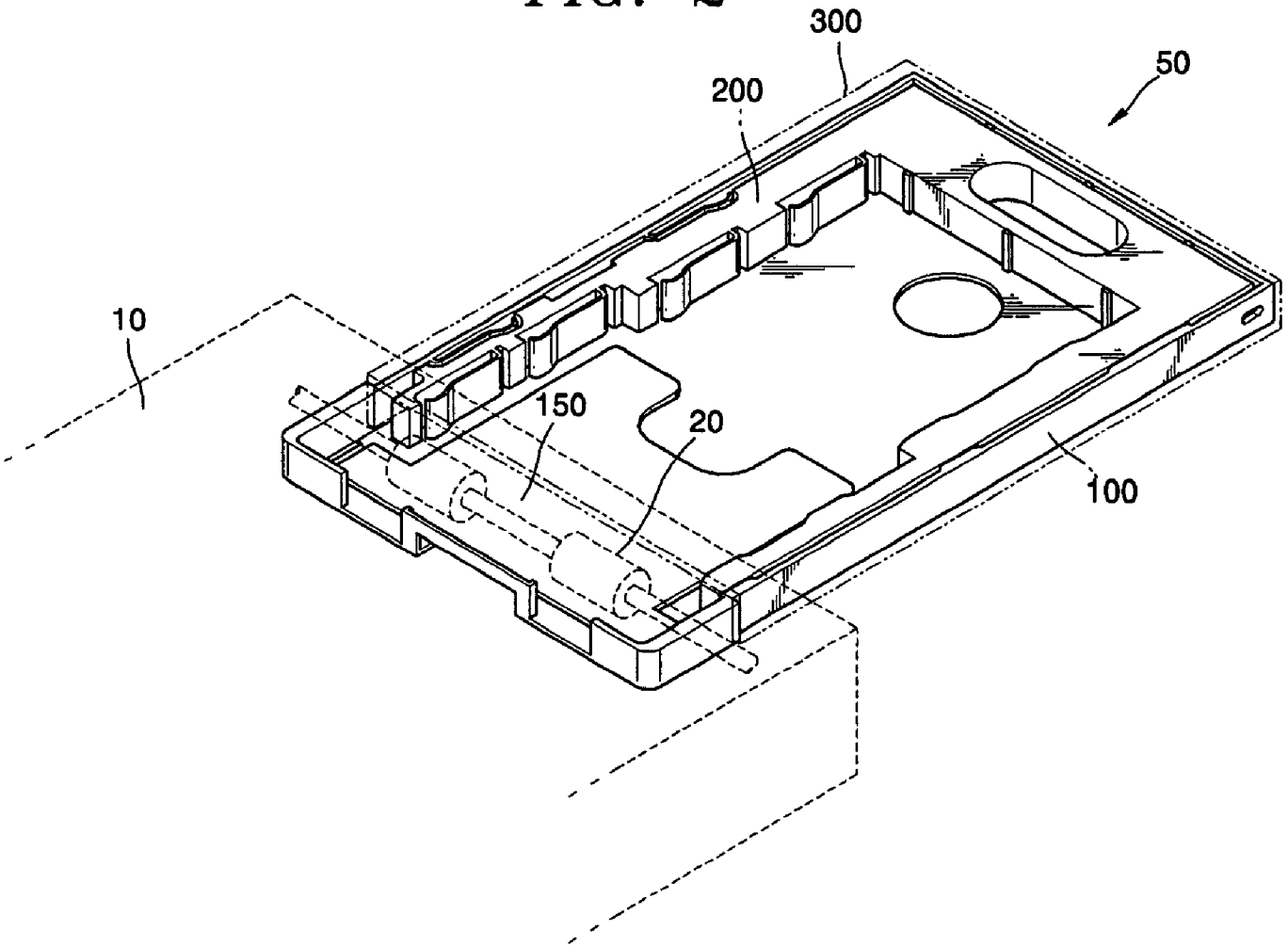
FIG. 2 is a perspective view showing the media cassette of FIG. 1 mounted in a printing apparatus.

FIG. 1 is an exploded perspective view showing a media cassette of a printing apparatus in accordance with an exemplary embodiment of the present invention. FIG. 2 is a perspective view showing the media cassette of FIG. 1 installed in the printing apparatus.

Figure 4:
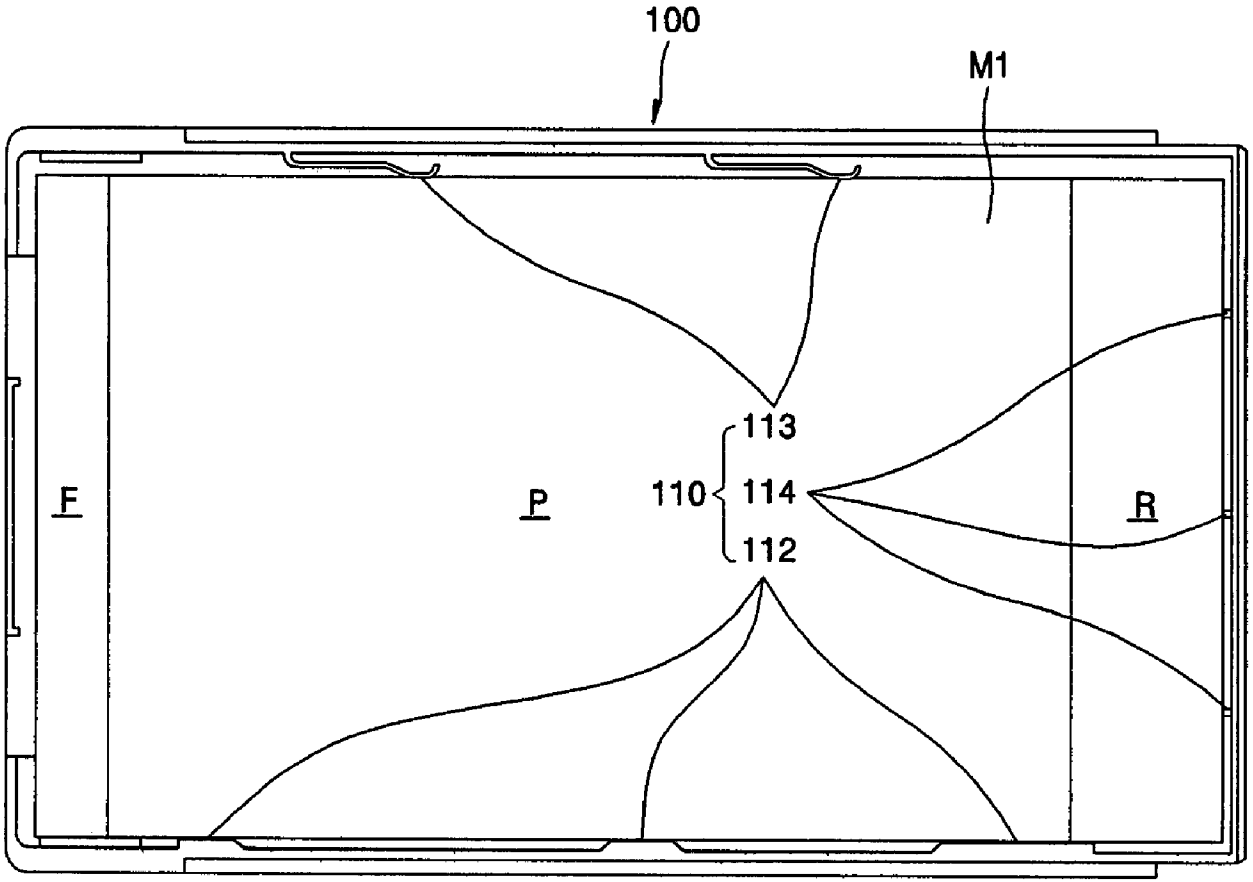
FIGS. 4 through 6 are plan views showing states of loading first through third media on the media cassette.

Referring to FIG. 1, the media cassette includes a loading case 100, a spacer 200, and an upper cover 300. The loading case 100 is preferably of suitable size for mounting a first medium M1 thereon. The loading case 100 includes a first guide 110 to guide side edges of the first medium M1 (FIG. 4). The first guide 110 includes a first elastic arm 113 that elastically guides an edge portion of the first medium M1 transversely. Additionally, there is also provided a first supporting portion 112 that guides the other edge portion of the first medium M1. Furthermore, a first stopper 114 guides an end portion of the first medium M1 longitudinally and is disposed in the loading case 100.

The spacer 200 is detachably installed on the loading case 100. The spacer 200 includes a structure by which a plurality of media can be guided. The spacer 200 is a substantially "U" shaped member having a stepped structure. The spacer 200 includes a second guide 210 to transversely guide both edges of a second medium (M2 in FIG. 5). Moreover, the spacer 200 includes a third guide 220 formed as step extending from the second guide 210 to transversely guide both edge portions of a third medium (M3 in FIG. 6). The second guide 210 includes a second elastic arm 213 and a second supporting portion 212. The second elastic arm 213 elastically guides one edge portion of the second medium M2 transversely. The second supporting portion 212 faces the second elastic arm 213 and guides the other edge portion of the second medium M2 transversely. The third guide 220 includes a third elastic arm 223 and a third supporting portion 222. The third elastic arm 223 elastically guides the edge portion of the third medium M3 transversely, and the third supporting portion 222 faces the third elastic arm 223 and guides the other edge portion of the third medium M3 transversely. A boundary forms a step between the second guide 210 and the third guide 220. The boundary forms a second stopper 211 to guide the end portion of the second medium M2 longitudinally. A third stopper 221 is provided to guide the end portion of the third medium M3 longitudinally and is disposed on the end portion of the third guide 220. According to the above structure, the spacer 200 preferably guides the second medium M2 which is smaller than the first medium Ml. Moreover, it is preferable that the spacer 200 guides the edge portions of the third medium M3 transversely and the end portion longitudinally. The third medium M3 has a shorter width than that of the second medium M2 and a longer length than that of the second medium M2.

In the present embodiment, the spacer 200 includes the second and third guides 210 and 220, and the second and third stoppers 211 and 221, However, the embodiment is not limited thereto, and alternative suitable arrangements and constructions may be used. Although it is not shown in drawings, the spacer 200 may further include additional guides that are successively stepped. The spacer 200 may then guide both edges of a plurality of media having different widths transversely. A plurality of stoppers are formed on stepped boundaries of the guides to both ends of the plurality of media longitudinally. When the spacer 200 has one or more stepped structures mounted on the loading case 100, any medium among the plurality of media having a smaller size than that of the first medium Ml may be selectively loaded in the loading case 100.

The spacer 200 is coupled to the loading case 100. A plurality of reference holes 104 are formed on the loading case 100. A plurality of bosses 201 may be inserted into the reference holes 104 and are formed on the spacer 200. Thus, the spacer 200 may be coupled in a predetermined position with respect to the loading case 100. The spacer 200 is formed so as not to interrupt the first guide 110. Also, it is preferable that the spacer 200 may be completely received in the loading case 100 for portability. A handle 230 is coupled to the space so as to be gripped by the user when the spacer 200 is mounted or separated in/from the loading case 100.

Figure 3:
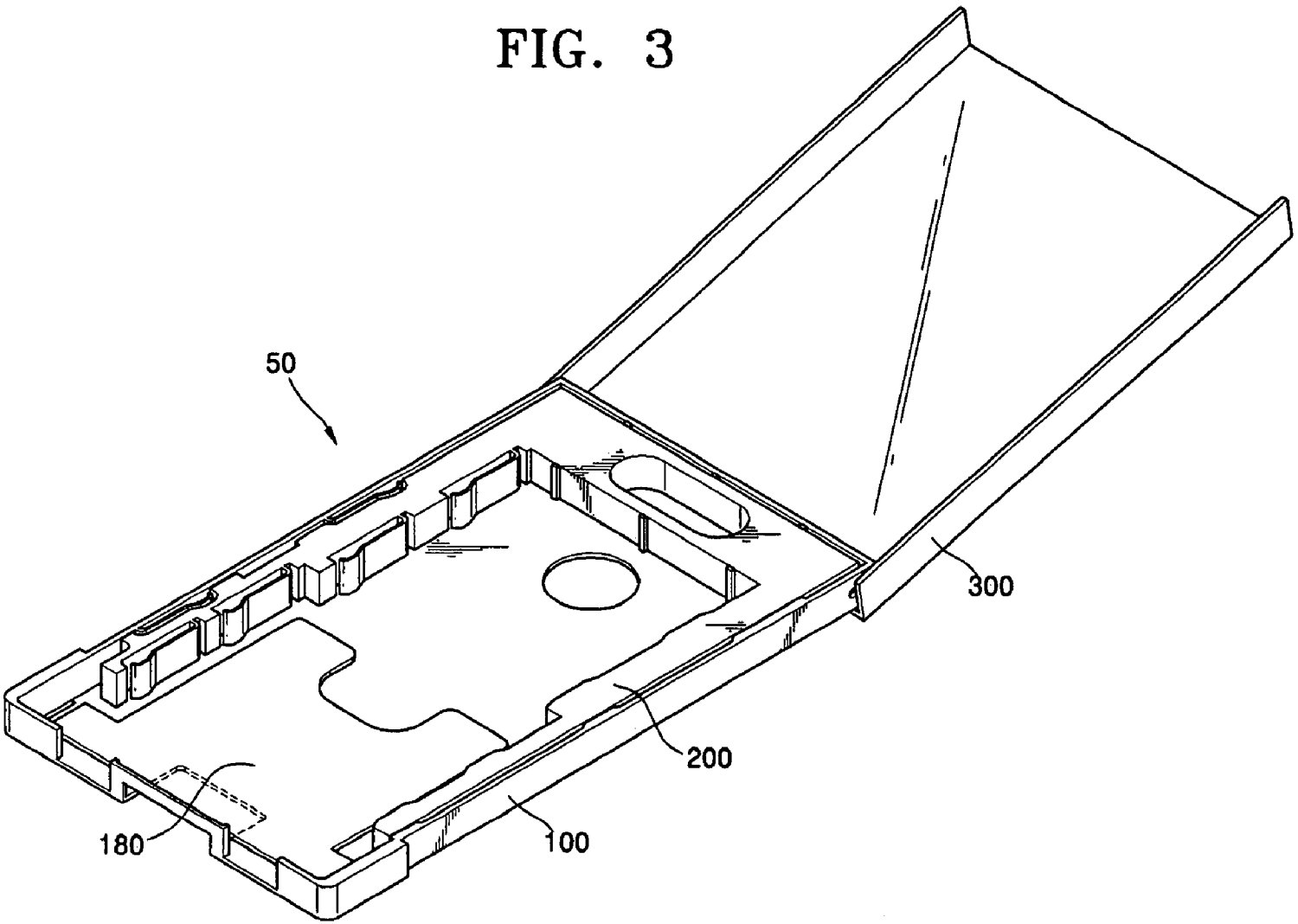
FIG. 3 is a perspective view showing the media cassette of FIG. 1, an upper cover of which is opened.

An upper cover 300 substantially covers an upper portion of the loading case 100; however, an outlet 150 is not covered so that a pickup device 20 disposed on the printing apparatus 10 may access the medium for pickup. The upper cover 300 is disposed so as to open the upper portion of the loading case 100. Therefore, the media may be loaded on the loading case 100. As shown in FIG. 3, the upper cover 300 is preferably rotatably coupled to the loading case 100. Thus, elongated portions 120 are located on both sides of the loading case 100, and bosses 301 are located on the upper cover 300. The bosses 301 are preferably inserted into the elongated portions 120.

It is desirable that the knock-up plate 180 does not interfere with the spacer 200 when the spacer 200 is mounted on the loading case 100. When the media cassette 50 is mounted in the printing apparatus 10, the knock-up plate 180 ascends due to a force provided by an elevating device (not shown) to push the media mounted thereon toward the pickup device 20. The pickup device 20 is disposed on the printing apparatus 10.

Hereinafter, operations and effects of the media cassette of the printing apparatus according to the embodiments of the present invention will be described. It is preferable that a size of the first medium M1 is about 4×6 inches, a size of the second medium M2 is about the size of a card, that is, about 86×54 mm, and a size of the third medium M3 is about 3×5 inches. The first, second, and the third media M1, M2, and M3, respectively, are media used for printing photographs. Media for printing photographs have printing regions P of the above described sizes, front margins F, and rear margins R. Therefore, the first through third stoppers 114, 211, and 221 are designed in consideration of the length of the printing region P, and the lengths of the front and rear margins F and R.

The user carries the media cassette so that the spacer 200 is coupled to the loading case 100. As shown in FIG. 3, when the first medium M1 is mounted, the upper cover 300 is opened to open the upper portion of the loading case 100. Then, the spacer 200 is removed from the loading case 100. As shown in FIG. 4, when the first medium M1 is mounted on the loading case 100, both the edges and ends of the first medium M1 are guided by the first supporting portion 112, the first elastic arm 113, and the first stopper 114 transversely and longitudinally. The first elastic arm 113 pushes the edge portion of the first medium M1 transversely toward the first supporting portion 112 elastically so as to prevent the first medium M1 from being skewed in the width direction.

Figure 5:
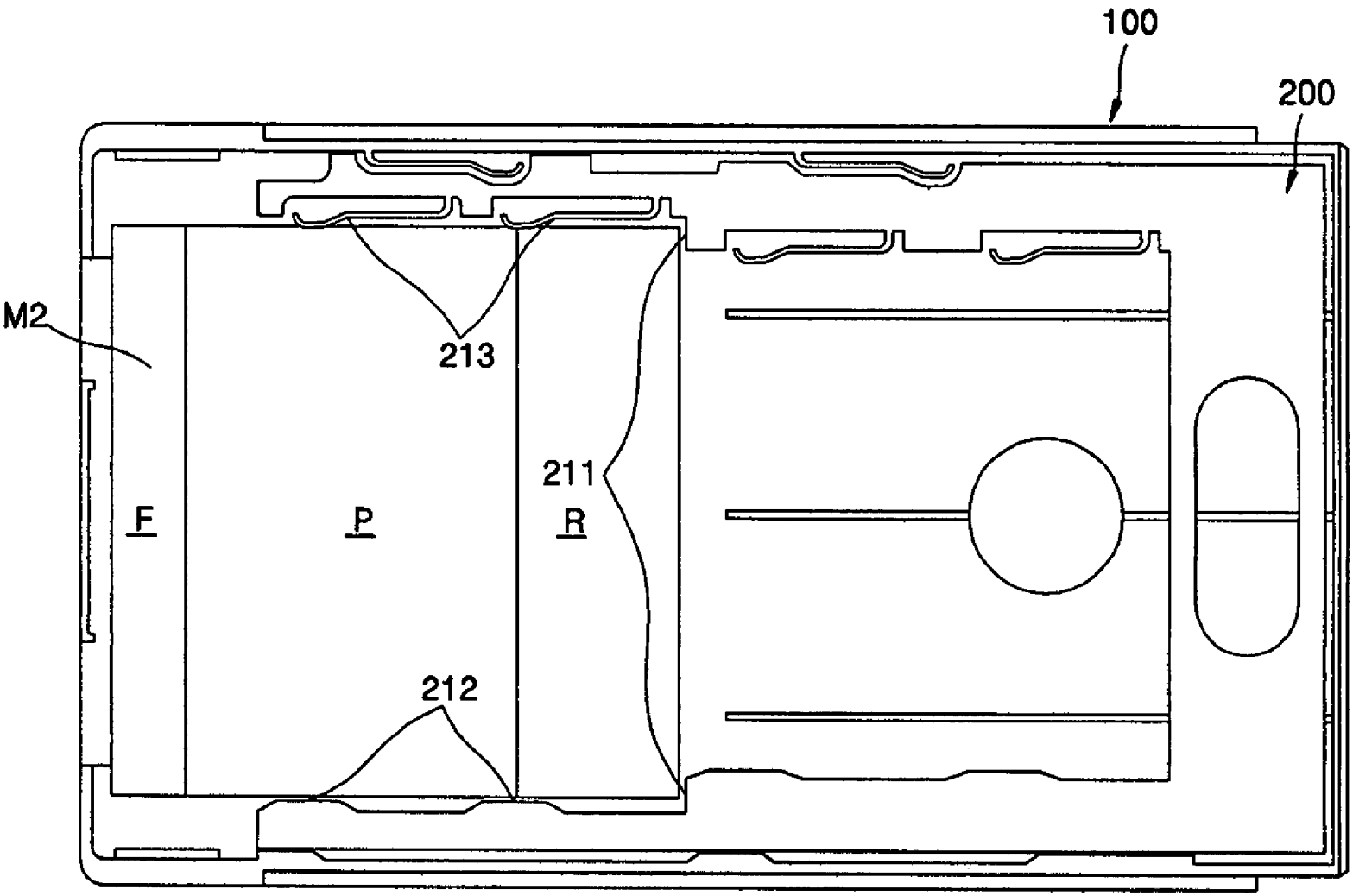
Figure 6:
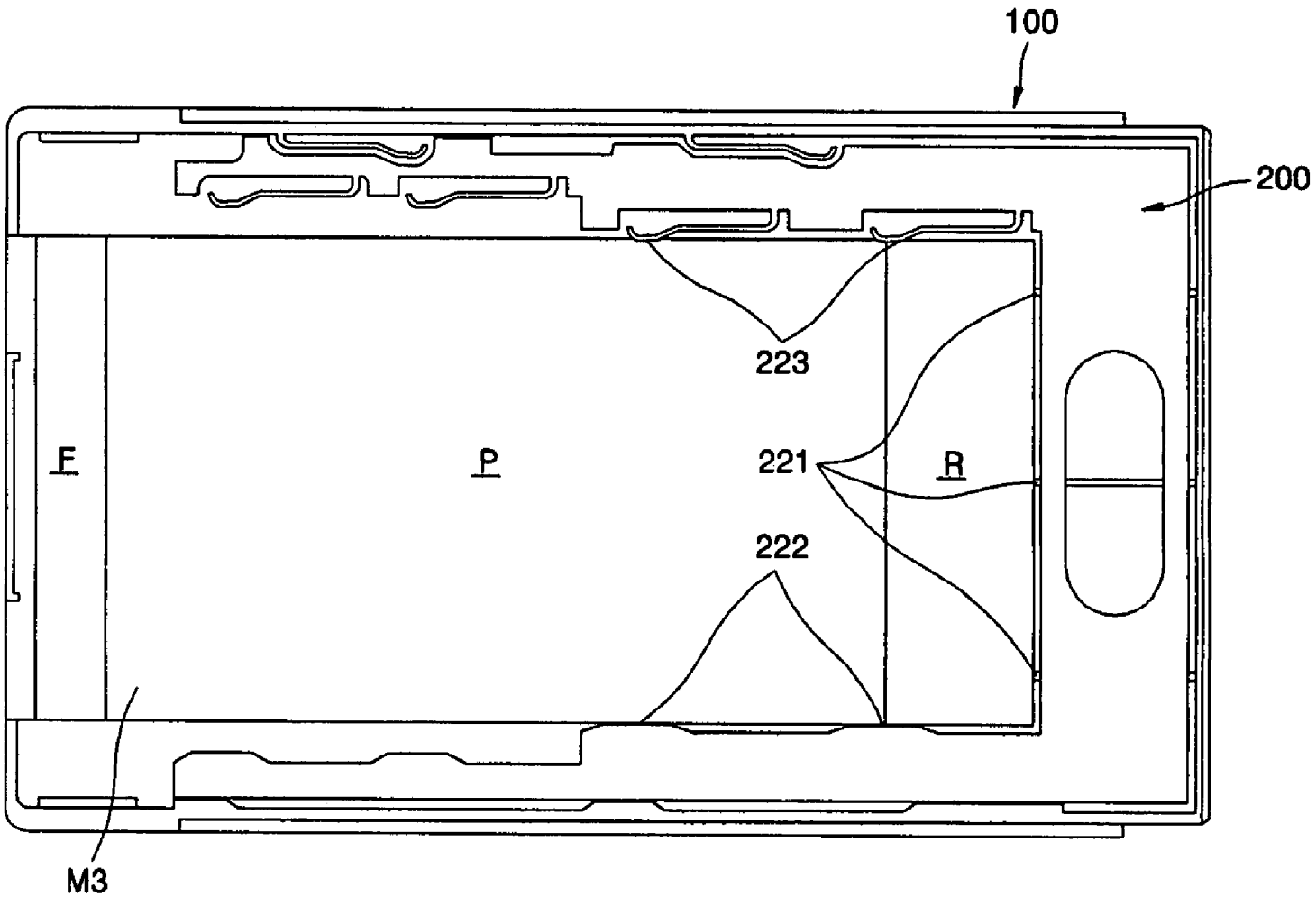

When the second or third medium M2 or M3 is mounted on the loading case 100, the spacer 200 is installed in the loading case 100. Here, the boss 201 is inserted into the reference hole 104, thereby mounting the spacer 200 into the appropriate position. As shown in FIG. 5, both edge portions and the end portion of the second medium M2 are guided by the second supporting portion 212, the second elastic arm 213, and the second stopper 211. The second elastic arm 213 pushes the end portion transversely toward the second supporting portion 212 elastically so as to prevent the second medium M2 from being skewed. As shown in FIG. 6, both edge portions and the end portion are guided transversely and longitudinally by the third supporting portion 222, the third elastic arm 223, and the third stopper 221. The third elastic arm 223 pushes the end portion transversely toward the third supporting portion 222 elastically so as to prevent the third medium M3 from being skewed.

Referring to FIG. 2, the media cassette 50 includes one of the first through third media M1, M2, and M3, and is mounted in the printing apparatus 10. Then, the pickup device 20 is located on the upper side of the medium, and the knock-up plate 180 lifts the media toward the pickup device 20. The pickup device 20 draws the medium through the outlet 150.

Figure 7:
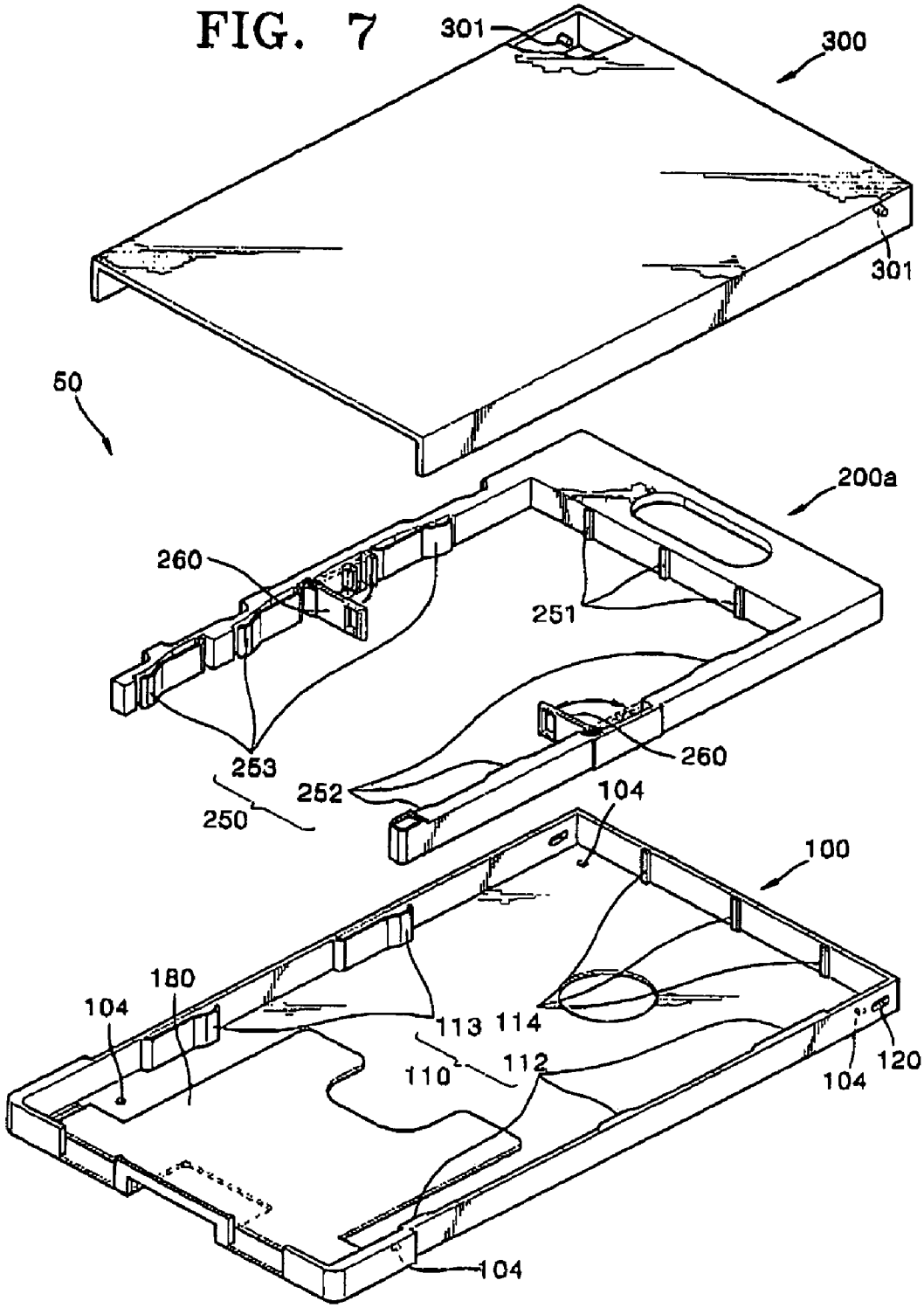
FIG. 7 is an exploded perspective view showing a media cassette of a printing apparatus in accordance with another embodiment the present invention.
Figure 8:
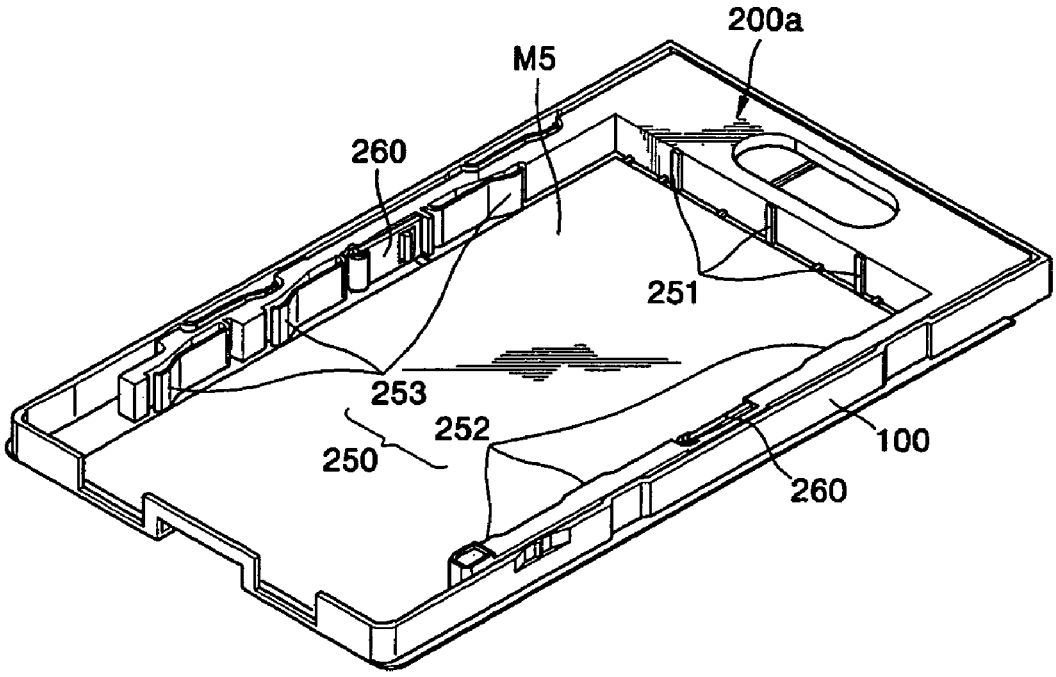
FIGS. 8 and 9 are perspective views showing states of loading fifth and sixth media on the media cassette.

FIG. 7 is an exploded perspective view showing another example of a media cassette of the printing apparatus according to an embodiment of the present invention. Referring to FIG. 7, a spacer 200*a* includes a fifth guide 250 and a fifth stopper 251. The fifth guide 250 guides both end portions transversely in a direction of the fifth and sixth media (M5 in FIG. 8 and M6 in FIG. 9) which have the same widths as that of each other. The fifth guide 250 includes a fifth elastic arm 253 and a fifth supporting portion 252. The fifth elastic arm 253 elastically guides one end portion of the fifth and sixth media M5 and M6 transversely, and the fifth supporting portion 252 faces the fifth elastic arm 253 to guide the other end portion of the fifth and sixth media M5 and M6. The fifth stopper 251 guides an end portion of the fifth medium M5 longitudinally. The spacer 200*a* further includes a rotary stopper 260 to guide an end portion longitudinally in a direction of the sixth medium M6 that has the same width as that of the fifth medium M5 and a shorter length than that of the fifth medium M5. The rotary stopper 260 is rotatably installed on the fifth guide 250. The rotary stopper 260 is rotated to a first position (a position denoted by a solid line in FIG. 7) for guiding the end portion of the sixth medium M6 and a second position (a position denoted by a dotted line in FIG. 7) for loading the fifth medium M5. Although it is not shown in the drawings, the spacer 200*a* may include a plurality of rotary stoppers that are rotated to a first position for guiding end portions of a plurality of media having the same width as and shorter lengths than that of the fifth medium M5 and a second position for loading the fifth medium M5. According to the above structure, one of the plural media, including the fifth medium M5 that is smaller than the first medium M1, may be loaded selectively by mounting the spacer 200*a* on the loading case 100. In order to load the fifth and sixth media M5, M6, the upper cover 300 is opened to open the upper portion of the loading case 100, and the spacer 200*a* is mounted on the loading case 100. At that time, the boss 201 is inserted into the reference hole 104, and the spacer 200*a* is mounted to a desired position. As shown in FIG. 8, in order to load the fifth medium M5, the rotary stopper 260 is rotated to the second position in order to not interfere with the fifth medium M5. As shown in FIG. 8, both end portions in the transverse direction of the fifth medium M5 and the end portion in the longitudinal direction of the fifth medium M5 are guided by the fifth supporting portion 252, the fifth elastic arm 253, and the fifth stopper 251. The fifth elastic arm 253 elastically pushes the end portion transversely toward the fifth supporting portion 252 to prevent the fifth medium M5 from skewing.

Figure 9:
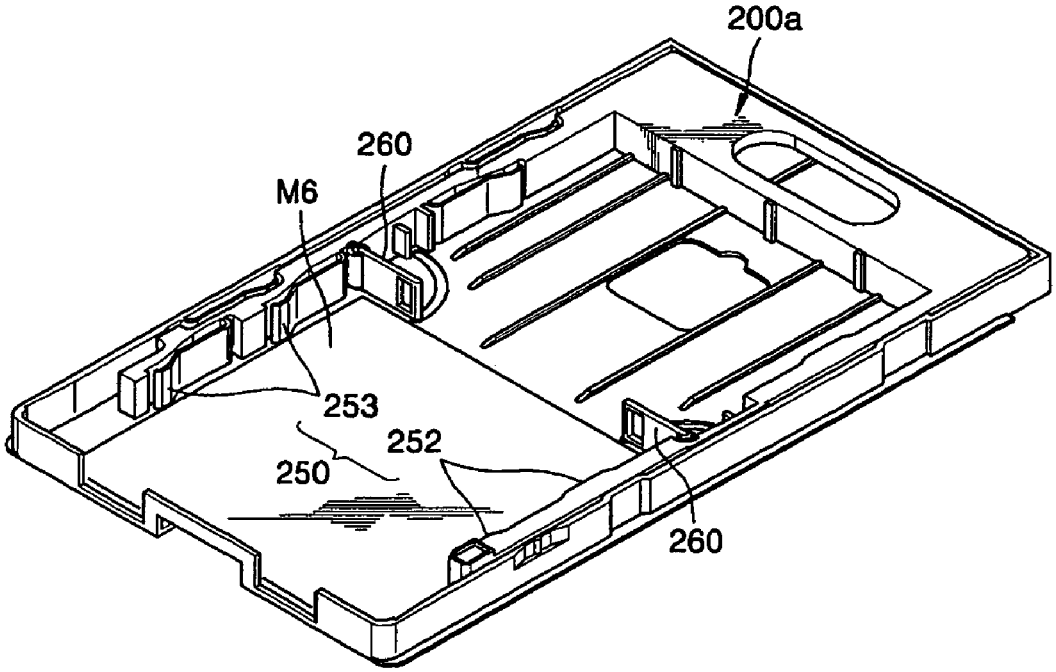

As shown in FIG. 9, in order to load the sixth medium M6, the rotary stopper 260 is rotated to the first position. Then, both end portions of the sixth medium M6 are transversely guided by the fifth supporting portion 252 and the fifth elastic arm 253, and the end portion in the longitudinal direction of the sixth medium M6 is guided by the rotary stopper 260.

Figure 10:
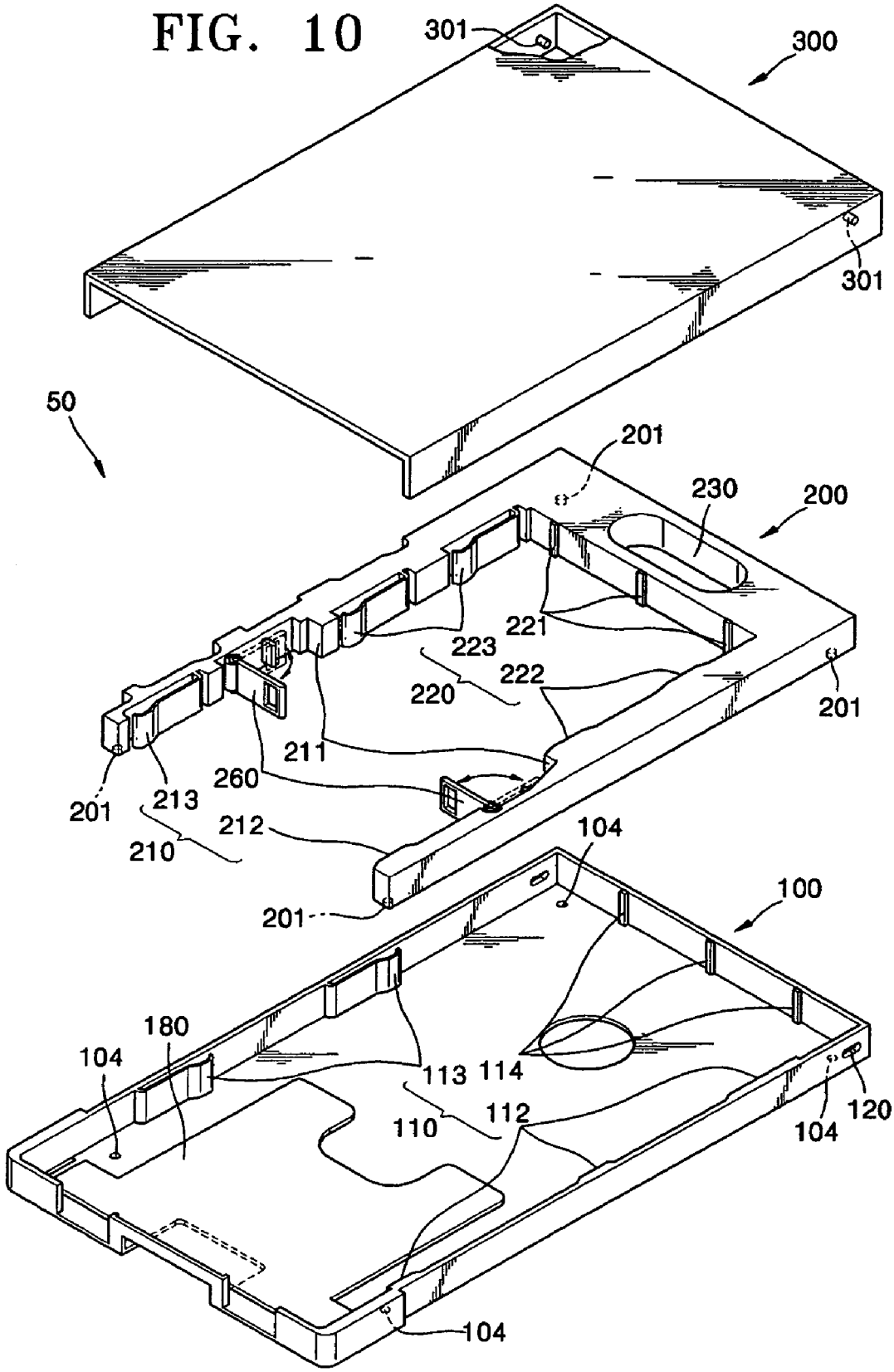
FIG. 10 is an exploded perspective view showing a media cassette of a printing apparatus in accordance with yet still another embodiment of the present invention.

The rotary stopper 260 may be applied to the spacer 200 as shown in FIG. 1. As shown in FIG. 10, the rotary stopper 260 may be installed on the second guide 210. When the second medium M2 is loaded, the rotary stopper 260 is rotated to the second position (denoted by a dotted line in FIG. 10), the fourth medium M4, that has the same width as and a shorter length than that of the second medium M2, and the rotary stopper 260 are rotated to the first position (denoted by a solid line in FIG. 10) for guiding the end portion of the fourth medium M4. Although it is not shown in the drawings, a rotary stopper 260 may be further installed on the third guide 220 in order to load another medium having the same width as and the shorter length than that of the third medium M3.

As described above, according to the media cassette of the printing apparatus of the present invention, various media having different sizes from each other can be loaded in the media cassette only by including the loading case and the spacer. Thus costs for producing and maintaining the media cassette can be reduced, and convenience of user to use the media cassette can be improved.

In addition, since the media cassette may be carried with the spacer mounted on the loading case, it may be carried conveniently. While the present invention has been particularly shown and described with reference to certain exemplary embodiments thereof, it will be understood by those of ordinary skill in the art that various changes in form and details may be made therein without departing from the spirit and scope of the present invention as defined by the following claims.

What is claimed is:

1. A detachable media cassette for a printing apparatus, the media cassette comprising:

a loading case, in which a first medium is loaded; and a spacer being detachably installed on the loading case to guide two or more media having different sizes from that of the first medium, wherein the spacer includes a plurality of guides arranged in successive steps to transversely guide edge portions of a plurality of media having different widths, and a plurality of stoppers formed on stepped boundaries between the plural guides to longitudinally guide end portions of the plural media;

wherein the spacer includes at least one rotary stopper rotatable to a first position to longitudinally guide an end portion of one of the two or more media and a second position to guide the other media.

2. A printing apparatus comprising:

a main body including a pickup device to pickup medium;

a detachable media cassette for a printing apparatus, the media cassette comprising:

a loading case, in which a first medium is loaded; and a spacer being detachably installed on the loading case to guide two or more media having different sizes, each size being different from that of the first medium, wherein the spacer includes:

a plurality of guides arranged in successive steps to transversely guide edge portions of a plurality of media having different widths, and a plurality of stoppers formed on stepped boundaries between the plural guides to longitudinally guide end portions of the plural media;

wherein the spacer includes at least one rotary stopper rotatable to a first position to longitudinally guide an end portion of one of the two or more media and a second position to guide the other media.

3. A detachable media cassette for a printing apparatus, the media cassette comprising:

a loading case, in which a first medium is loaded; and a spacer being detachably installed on the loading case to guide two or more media having different sizes from that of the first medium, wherein the spacer includes a plurality of guides arranged in successive steps to transversely guide edge portions of a plurality of media having different widths, and a plurality of stoppers formed on stepped boundaries between the plural guides to longitudinally guide end portions of the plural media;

wherein the spacer comprises a second guide to transversely guide edge portions of a second medium;

a third guide arranged to be stepped inwardly from the second guide, the third guide is configured to guide edge portions of a third medium having a narrower width and a longer length than those of the second medium;

a second stopper formed on a stepped boundary between the second and third guides to longitudinally guide an end portion of the second medium; and a third stopper to longitudinally guide an end portion of the third medium.

4. The media cassette of claim 3, wherein the second and third guides, respectively, include a second arm and a third arm to elastically and transversely guide at least one edge portion of the second and third media, respectively.

5. The media cassette of claim 3, wherein the spacer further includes a rotary stopper installed on at least one of the second and third guides, the rotary stopper being rotatable to a first position to longitudinally guide an end portion of a fourth medium, the fourth medium has the same width and a shorter length than that of the medium guided by the at least one of the second and third guides, and the rotary stopper is rotatable to a second position to load the medium guided by the at least one of the second and third guides.

6. A detachable media cassette for a printing apparatus, the media cassette comprising:

a loading case, in which a first medium is loaded; and a spacer being detachably installed on the loading case to guide two or more media having different sizes from that of the first medium, wherein the spacer includes a plurality of guides arranged in successive steps to transversely guide edge portions of a plurality of media having different widths, and a plurality of stoppers formed on stepped boundaries between the plural guides to longitudinally guide end portions of the plural media;

wherein the spacer includes:

a fifth guide to transversely guide edge portions in a width direction of a fifth medium;

a fifth stopper to longitudinally guide an end portion of the fifth medium; and a rotary stopper installed on the fifth guide, the rotary stopper is rotatable to a first position to guide an end portion of a sixth medium, the sixth medium has the same width as and a shorter length than that of the fifth medium, and the rotary stopper is rotatable to a second position to load the fifth medium.

7. The media cassette of claim 6, wherein the fifth guide includes a fifth elastic arm to elastically and transversely guide at least one end portion of the fifth and sixth media.

8. A detachable media cassette for a printing apparatus, the media cassette comprising:

a loading case, in which a first medium is loaded; and a spacer being detachably installed on the loading case to guide two or more media having different sizes from that of the first medium, wherein the spacer includes a plurality of guides arranged in successive steps to transversely guide edge portions of a plurality of media having different widths, and a plurality of stoppers formed on stepped boundaries between the plural guides to longitudinally guide end portions of the plural media;

wherein the spacer includes:

a fifth guide to transversely guide both edge portions of the fifth medium;

a fifth stopper to longitudinally guide an end portion of the fifth medium; and at least one rotary stopper installed on the fifth guide configured to rotate to a first position to guide edge portions of a plurality of media having the same widths and shorter lengths than that of the fifth medium, and the rotary stopper configured to rotate to a second position to load the fifth medium.

* * * * *